United States Patent [19]

Stancato

[11] Patent Number: 4,934,739

[45] Date of Patent: Jun. 19, 1990

[54] ALBUM PAGE DESIGN

[75] Inventor: Enzo Stancato, Greenwich, Conn.

[73] Assignee: Albumx Corp., Port Chester, N.Y.

[21] Appl. No.: 294,647

[22] Filed: Jan. 9, 1989

[51] Int. Cl.[5] ..... B42D 1/08; B42F 3/00

[52] U.S. Cl. ..... 281/38; 40/159; 40/158.1; 40/537; 281/15.1

[58] Field of Search ..... 40/158.1, 159, 533, 40/537, 530; 281/15 R

[56] References Cited

U.S. PATENT DOCUMENTS

| | | | |
|---|---|---|---|
| 32,404 | 5/1861 | Anthony et al. | 40/537 |
| 215,524 | 5/1879 | Kena | 40/537 |
| 2,498,738 | 2/1950 | Lewis | 40/159 |
| 2,616,431 | 11/1952 | Kalwajtys | 40/537 |
| 2,639,531 | 5/1953 | Engemann | 40/158.1 |
| 4,184,278 | 1/1980 | Fournet | 40/158.1 |
| 4,378,647 | 4/1983 | Stancato | 40/158.1 |
| 4,413,434 | 11/1983 | Rupert et al. | 40/159 |
| 4,601,489 | 7/1986 | Stancato | 40/159 |

FOREIGN PATENT DOCUMENTS

| | | | |
|---|---|---|---|
| 1376534 | 9/1964 | France | 40/533 |

*Primary Examiner*—Paul A. Bell
*Assistant Examiner*—Yu-Chi Lin

[57] ABSTRACT

This invention relates to a new and improved design associated with the fabrication and construction of a prebound album wherein the individual pages of said album are selectively interchangeable in accordance with the invention, each particular page evidencing a new and unique method of fabrication and construction capable of having mounted thereon, in accordance with the invention, a photograph or other item for display purposes so as to achieve an overall aesthetically appearing album design.

4 Claims, 6 Drawing Sheets

ALBUM PAGE DESIGN

BACKGROUND AND OBJECTS OF THE INVENTION

The present invention relates generally to a new and improved design for the fabrication and construction of a prebound album wherein the individual pages of said album are selectively interchangeable in accordance with the invention, each particular page evidencing a new and unique method of fabrication and construction capable of having mounted thereon, in accordance with the invention, a photograph or other item for display purposes so as to achieve an overall aesthetically appearing album design.

The prior art in existence to data addresses a variety of methods and techniques whereby album designs, as well as the fabrication and construction thereof have been disclosed. It is in keeping with said prior art teachings that the present invention seeks to address a new and novel page associated with utilization within such prior art devices, it being within the scope of the present invention to, in fact, utilize in conjunction with the present invention, the teachings and disclosure of this Inventor's U.S. Pat. No. 4,601,489, issued Jul. 22, 1986, and more particularly, to incorporate the interconnecting spinal component therein set forth as the preferred spinal component to be utilized in accordance with the particularized page design and structure as herein set forth.

Furthermore, and in keeping with the invention, each individual page of said album is fabricated in any one of a number of unique and individualized structures, each capable of being selectively inserted into an overall album design, but yet capable of retaining individualized structural characteristics as related to the mounting thereon of particularized photographs and the like for display within said album.

Altough prior art albums exist capable of having selectively mounted therein and/or deleted thereform individualized pages, the present invention overcomes many of the disadvantages and drawbacks of the prior art device in that the present invention results in the achieving of interchangeability of pages without loosing the aesthetic attributes associated with the particular pages associated with the present invention which allow for unique mounting capabilities associated therewith thereby achieving an overall appearance as related to said album design of an album that is prebound in nature.

It is another object of the invention to create a new and improved design as related to individualized pages capable of selective insertion within an album design within said individualized page is capable of receiving on either face thereof an individualized picture or other item for display purposes which, upon insertion into the structure of said individualized page, results in the symmetrical mounting of said picture as related thereto as well as providing about the perimeter of said picture an overlay border.

It is another object of the invention to create a new and improved design as related to individualized pages capable of selective insertion within an album design wherein said individualized page is capable of receiving on either face thereof an individualized picture which, upon insertion into the structure of said individualized page, results in the symmetrical mounting of said picture as related thereto as well as providing about the vertical edges of said picture an overlay border.

It is another object of the invention to create a new and improved design as related to individualized pages capable of selective insertion within an album design which is capable of utilization with any form of binding technique.

The objects and advantages of the invention are set forth in part herein and in part will be obvious herefrom, or may be learned by practice of the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

Figure 1:
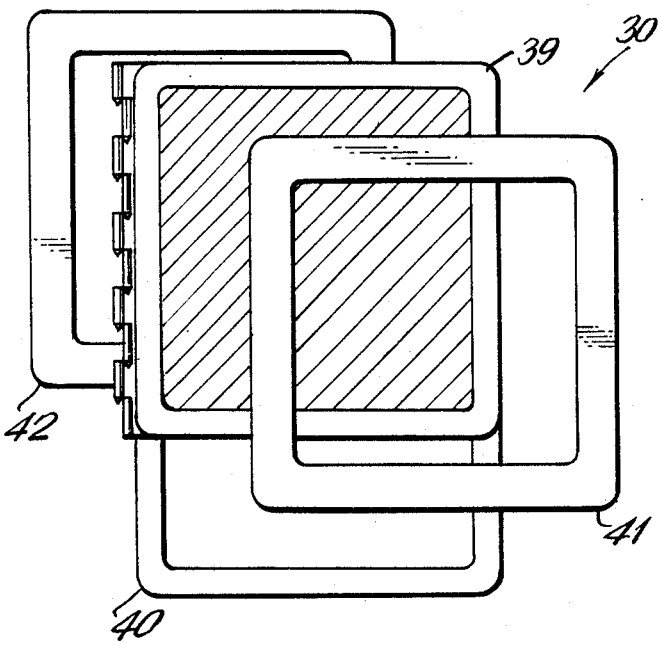
FIG. 1 is a perspective view of the component parts of a page of an album constructed in accordance with the invention evidencing five layers of construction.

This invention relates to a new and improved concept and design associated with the fabrication and construction of a prebound album wherein the individual pages of said album are selectively interchangeable in accordance with the invention, each particular page evidencing a new and unique method of fabrication and construction capable of having mounted thereon, in accordance with the invention, a photograph or other item for display purposes so as to achieve an overall aesthetically appearing album design as well as for utilization in other display techniques by they frames, or the like.

In keeping with the invention, a page design is utilized incorporating the utilization of the interconnecting spinal component disclosed by applicant herein in applicant's prior issued U.S. Pat. No. 4,601,489 issued Jul. 22, 1986, although utilization of other interconnecting spinal components are within the scope of this invention.

As herein set forth, the page utilized in accordance with the preferred embodiment of the invention comprises a base page element structurally bound to an interconnecting spinal component, said individual spinal component being constructed in a fashion so as to selectively interconnect with themselves as to thereby achieve a selectively assembled binding independent of the number of pages determined to be utilized as to said particularized album.

Furthermore, and in keeping with the invention and as related to said preferred embodiment, there is structurally affixed to either side of said base page a bottom guide member whose dimensions are such as to be equivalent to the combined overall dimensions of said base page as mounted upon said interconnecting spinal component as depicted in the figures, said bottom guide members defining an opening, be it rectangular, or otherwise.

On top of said bottom guide members as related to said preferred embodiment there is thereafter structurally affixed upper guide members to said bottom guide members the outer dimensions of said upper guide members being equivalent to the dimensions of said bottom guide members said upper guide members also defining a center opening, be it rectangular or otherwise, said center opening being compatible in shape with the opening formed in said bottom guide member over which said upper guide member has been placed, said compatible opening, however, being slightly smaller in size so as to provide an overlap of surface about the opening defined by said bottom guide members, the upper guide member being structurally affixed about said bottom guide member on only three of the four sides thereof thereby allowing for ther selective insertion as well as removal of a photograph and/or other item of display from between said bottom guide member and said upper guide member.

A mat assembly is additionally utilized in conjunction with the invention, whereby a particular picture for display is mounted therein, thereby enabling in accordance with the invention said picture upon a page of said album.

In keeping with the invention, other embodiments thereof are disclosed and illustrated, all of which being emcompassed within the invention.

The accompanying drawings referred to herein and constituting a part hereof are illustrative of the invention but not restrictive thereof, and, together with the description, serve to explain the principles of the invention.

DESCRIPTION OF A PREFERRED EMBODIMENT

Referring now more particularly to the embodiment of the above invention illustrated in the accompanying drawings, there is illustrated in FIG. 1 a perspective view of the comnponent parts of a page 30 of an album constructed in accordance with the invention.

Figure 2:
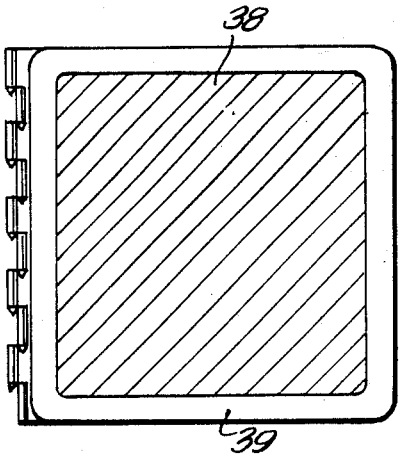
FIG. 2 is a front elevational view of the middle layer of the page illustrated in FIG. 1 constructed in accordance with the invention wherein the front bottom guide member is affixed thereto.
Figure 3:
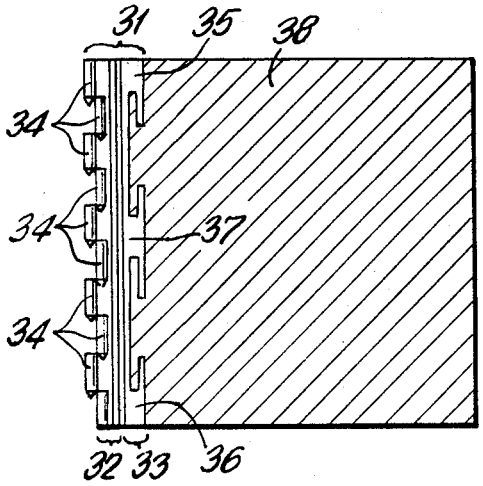
FIG. 3 is a front elevational view of a portion of the middle layer of the page illustrated in FIG. 2 evidencing the interconnecting spinal component utilized therein in conjunction with its center core structure.

As therein depicted and as further illustrated in FIGS. 2 and 3, interconnecting spinal component 31 is comprised of interconnecting tubular array 32 and structural member 33. As illustrated in FIG. 3, interconnecting tubular array 32 has individual spine members 34 angularly affixed thereto, said interconnecting tubular array 32 being formed to additionally define structural member 33 whose exposed portion is of a design so as to define component members 35, 36 and 37. It should be noted that it is within the scope of this invention not to limit it to the patent structure associated with interconnecting spinal component 31, but rather, any spinal component capable of selective insertion into a binding structure, or otherwise, falls within the scope of the present invention.

As illustrated in FIG. 3, component members 35, 36 and 37 are basically rectangular in design, however, it is within the scope of the invention to note that said configuration should not be considered limiting in nature.

In keeping with the invention, and as further depicted in FIG. 3, interconnecting spinal component 31 is compatible in design with center core member 38 of page 30. As depicted in FIG. 3, center core member 38 is basically rectangular in shape, however, formed along its edge that comes into structural contact with interconnecting spinal component 31 there is formed "T" shaped structures capable of interfitting with component members 35, 36 and 37 so as to form a structurally interconnecting unit hereinabove noted as center core member 38 of page 30.

In keeping with the invention, and as illustrated in FIG. 2, there is structurally affixed to center core member 38 by ashesive means, or otherwise, bottom guide member 39 as therein illustrated.

More particularly, bottom guide member 39 is basically rectangular in shape having outer dimensions compatible with the combined dimensions of center core member 38 as same interconnects with structural member 33 of interconnecting spinal component 31 and otherwise defines a rectangular opening as illustrated in FIG. 2.

By causing bottom guide member 39 to be structurally affixed to center core member 38 and structural member 33 as illustrated in FIG. 2 and FIG. 3, there is achieved the mechanical integrity between center core member 38 and interconnecting spinal component 31 so as to form the foundation by which page 30 is constructed.

As illustrated in FIG. 1, center core member 38 in addition to having bottom guide member 39 structurally affixed thereto as set forth above, also has on its reverse side, bottom guide member 40 similarly so affixed.

It should be noted that in conjunction with the affixing of bottom guide member 39 and bottom guide member 40, respectively, to center core member 38 and structural member 33, that same is achieved by utilizing, in this preferred embodiment, any adhesive material known within the prior art, the entire surface of bottom guide member 39 as well as the entire surface of bottom guide member 40, which are to come into contact with center core member 38 and structural member 33, having said adhesive material affixed thereto so that there is complete bonding over the entire common surface therebetween.

Additionally, as futher illustrated in FIGS. 1 and 2, the cross-sectional width of that portion of bottom guide member 39 as well as bottom guide member 40 as related to that portion of said bottom guide member 39 and said bottom guide member 40 which overlay structural member 33 and that portion of center core member 38 immediately adjacent thereto, are of such dimensions as to be slightly greater than the width of structural member 33.

Additionally, it should be noted, that in keeping with the invention, as to this preferred embodiment, and as depicted in the drawings, bottom guide member 39 and bottom guide member 40 are identical in their dimensions and symmetrical. It is, however, within the scope of this invention, to vary same so that different formats can occur on either side of a particular page 30 as defined by bottom guide member 39 versus bottom guide member 40, and additionally, nothing should be considered as to so limit the invention as to having bottom guide member 39 and/or bottom guide member 40 define a rectangular opening, other geometrical defined openings being within the scope of the invention.

Figure 4:
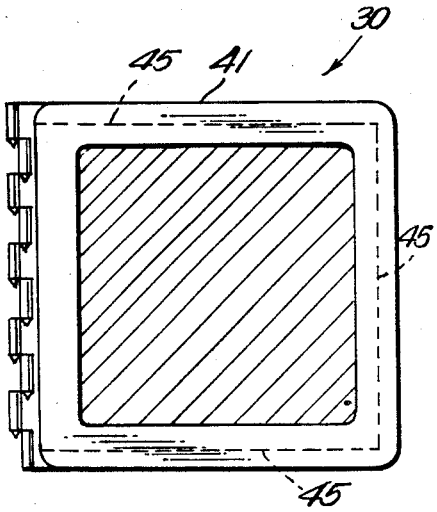
FIG. 4 is a front elevational view of the page illustrated in FIG. 1 constructed in accordance with the invention wherein all five layers thereof have been assembled.

In further keeping with the invention, and as illustrated in FIG. 4, after bottom guide member 39 and bottom guide member 40 have been structurally affixed to center core member 38 and structural member 33, the next step in the fabrication of page 30 is to then structurally affix top guide member 41 and top guide member 42 to page 30.

As is the case with bottom guide members 39 and 40, top guide members 41 and 42 are also, as illustrated in the drawings and as set forth in this preferred embodiment, basically rectangular in shape having outer dimentsions compatible with the overall dimension that are compatible with the combined dimensions of center core member 38 and structural member 33.

Additionally, as was stated with regard to bottom guide members 39 and 40, top guide members 41 and 42 are structurally affixed to bottom guide member 39 and bottom guide member 40, respectivly, by the utilization of any known prior art adhesive, it being within the scope of this invention, however, that upon affixing top guide member 41 to bottom guide member 39 as well as top guide member 42 to bottom guide member 40, that a portion of top guide member 41 and top guide member 42, respectively, that adheres parallel to interconnecting spinal component 31, has no adhesive attachment to the underlying portion of bottom guide member 39 and/or bottom guide member 40, respectively, as the case may be.

More particularly, and as illustrated in FIG. 4, the adhesive area applicable to the above between top guide member 41 as related to bottom guide member 39 comprises the area defined between the outer dimensions of top guide member 41 and dashed line 45, there being achieved by the above, a planar surface area between top guide member 41 and bottom guide member 39 which is thus free of any adhesive material and thus capable of allowing for the insertion therebetween of a mat structure 43 as hereinafter defined.

Figure 7:
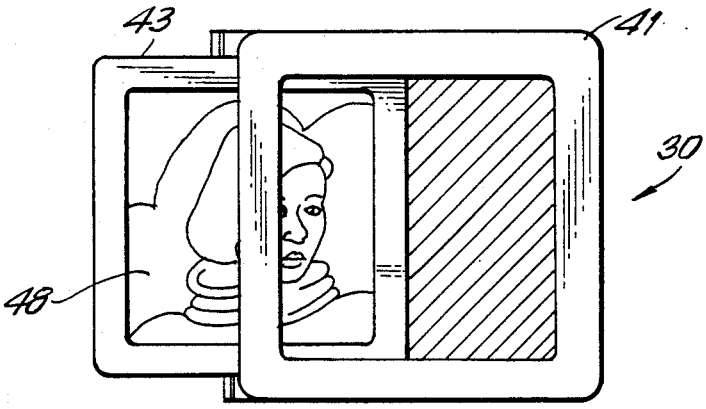
FIG. 7 the mounting of the mat illustrated in FIG. 5 upon the surface of the page as illustrated in FIG. 4.

As a result, and as illustrated in FIG. 7, there is thereby achieved the ability to have selectively placed into and otherwise from an envelope type structure thereby created, as related to page 30, a means to achieve the selective insertion and/or removal of a particlar picture, or the like, from a particular face of a particular page 30, all being in accordance with the invention.

As has been stated above, in conjunction with the parameters and/or variations applicable and/or otherwise relevant to the discussions associated with bottom guide member 39 and bottom guide member 40, same is similarly applicable as related to top guide member 41 and top guide member 42. More particularly, top guide member 41 and top guide member 42 are identical in their dimensions and symmetrical and compatible with bottom guide members 39 and 40, respectively. It is, however, within the scope of this invention, to vary same so that different formats can occur on either side of a particular page 30 as defined by top guide member 41 versus top guide member 42, and additionally, nothing should be considered as to so limit the invention as to having top guide member 41 and/or top guide member 42 define a rectangular opening, other geometrical defined openings being within the scope of the invention.

Figure 5:
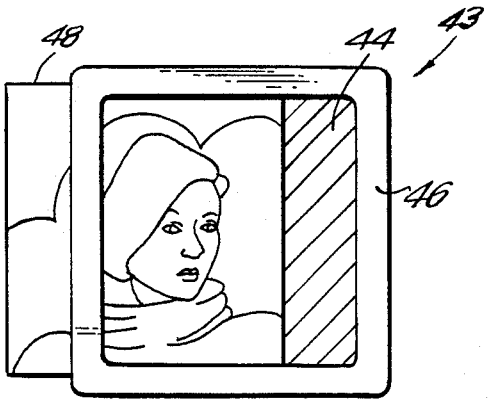
FIG. 5 is a front elevational view of a mat having partially slipped therein a picture which is to be mounted upon the front face of the page illustrated in FIG. 4.
Figure 6:
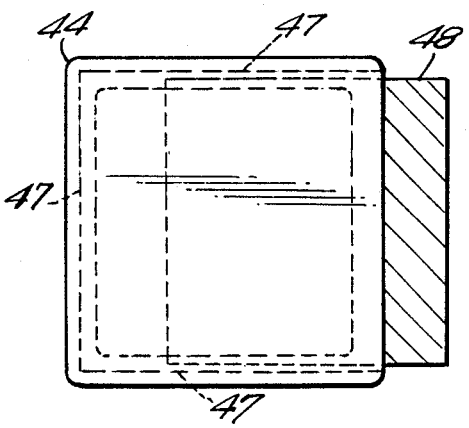
FIG. 6 is a rear elevational view of the mat illustrated in FIG. 5 having a picture partially slipped therein.

In further keeping with the invention, and as illustrated in FIGS. 5 and 6 of the drawings, there is therein illustrated mat structure 43 which comprises a base member 44 which, as illustrated in FIGS. 5 and 6, is rectangular in shape and compatible in size with the opening defined by top guide member 41, the overall dimensions of base member 44 being slightly larger than the opening defined by top guide member 41.

In further keeping with the invention, and in further reference to FIGS. 5 and 6, base member 44 of mat structure 43 has structurally affixed to its face, a rectangular frame member 46 whose outer dimensions are identical with and otherwise compatible with the overall dimensions of base member 44, said frame member 46 additionally defining a rectangular opening as illustrated in FIG. 5. As discussed above with regard to FIG. 4 and the affixing of top guide member 41 to bottom guide member 39, frame member 46 is similarly structurally affixed to base member 44.

More particularly, any adhesive material well known within the prior art is utilized to define an area between the outer dimensions of base member 44 and dashed line 47 as illustrated in FIG. 6, said area defining, where, as between base member 44 and frame member 46 structural adhesion occurs therebetween.

As is illustrated in FIG. 6, once frame member 46 is structural affixed to base member 44 in accordance with the above, there is defined an envelope-like structure capable of allowing for the physical insertion between frame member 46 and base member 44 of a picture 48, and/or the like, as illustrated in FIGS. 5 and 6, the above being in accordance with the invention.

As is illustrated in FIGS. 5 and 6, picture 48 is capable of selectively being inserted and/or removed from mat structure 43 in a simplistic manner so as to achieve various expediencies associated with the invention. Additionally, upon the insertion of picture 48 into mat structure 43 as illustrated in FIGS. 5 and 6, same being in accordance with the invention, there is achieved the ability to cause picture 48 to be aesthetically mounted thereon and otherwise provide an overlay arrangement associated therewith consistent with and otherwise desirable as related to a photo album.

The above is achieved, in part, as a result of the fact that the non-adhesive areas between base member 44 and frame member 46 as depicted in FIG. 6 are selectively sized so as to be compatible with the insertion of a particularly sized picture 48.

Upon insertion of picture 48 into mat structure 43, mat structure 43 is then inserted into the structure of page 30 as illustrated in FIG. 7 in accordance with the invention. As illustrated in FIG. 4 and FIG. 7, upon viewing same simultaneously, it becomes readily apparent, that in accordance with this invention, there is achieved the ability to selectively mount, upon page 30 of the invention, mat structure 43 such that there is achieved the mounting of picture 48 upon the face of page 30.

In keeping with the above, and upon the structural interconnection of a number of pages constructed in accordance with the invention, one achieves in an overall embodiment, an album constructed in accordance with the invention.

Figure 8:
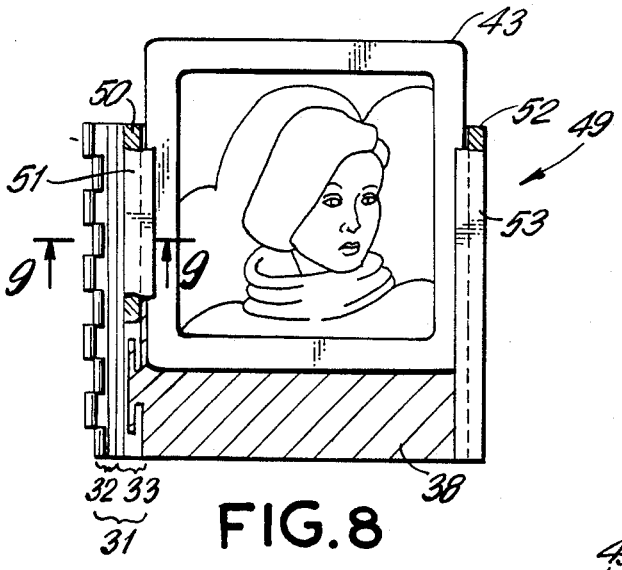
FIG. 8 is an alternative embodiment to the structure of the page as illustrated in FIG. 1 constructed in accordance with the invention.

Reference is now herein made in FIGS. 8 through 11 wherein there is depicted an alternative embodiment of the invention. As illustrated in FIG. 8, a page 49 is illustrated comprising interconnecting spinal component 31 and center core member 38 as initially depicted in FIG. 3.

In keeping with the invention, strip member 50 is adhesively affixed parallel to interconnecting spinal component 31 and structurally adjacent to structural member 33. In this fashion, there is achieved, as discussed with the preferred embodiment of the invention as set forth above, a mechanical and structural interfit between center core member 38 and interconnecting spinal component 31.

Figure 9:
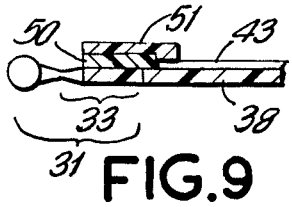
FIG. 9 is a partial cross sectional view taken along lines 9—9 of FIG. 8.

Reference is now herein made to FIG. 9 which is a partial cross-sectional view taken along lines 9—9 of FIG. 8 wherein there is illustrated the postioning of strip member 50 adjacent to structural member 33 after strip member 50 has been adhesively affixed to structural member 33, same occurring, however, as therein illustrated, only upon one surface of page 49. It should additionally be noted that it is within the scope of this invention to have the identical structure evidenced in FIG. 9 which appears on a particular surface of center core member 38 also appear, in a mirror image, upon the other surface thereof.

In further keeping with the invention, guide member 51 is structurally affixed to strip member 50 be adhesive means or otherwise, along the entire length of strip member 50 so as to provide for the ability of having mat structure 43, or any other compatible mat structure selectively slid into the spacing created between guide member 51 and center core member 38 as illustrated in FIG. 9.

As further indicated in FIG. 8, the structural relationship between strip member 50, guide member 51 and center core member 38, is repeated along the exterior portion of center core member 38 which runs parallel to interconnecting spinal component 31 as illustrated in FIG. 8. As illustrated in FIG. 8, there is provided by the utilization of strip member 52 and guide member 53 the comparable structure as illustrated in FIG. 9, along the exterior boundaries of center core member 38 as depicted in FIG. 8 compatible with the structure depicted in FIG. 9 such that, as illustrated in FIG. 8, there is the ability to have inserted mat structure 43 upon page 49 so as to achieve the ability to have selectively mounted thereon, a picture. Although not illustrated in FIG. 9, the structure of strip member 50 and guide member 51 are repeated upon the reverse surface of center core member 38 as is the case with guide member 53 and strip member 52, respectively, such that, page 49 is capable of having inserted on either surface thereof, mat structure 43.

Figure 10:
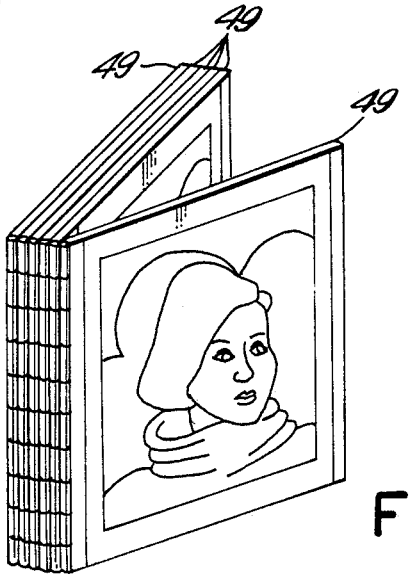
FIG. 10 illustrates the interlocking of several of the pages as illustrated in FIG. 8.

Upon making reference to FIG. 10, there is illustrated therein, a number of pages designated by reference numeral 49, assembled in accordance with the invention, so as to form the basic structure of an album consistent with and otherwise incorporating the scope of this invention.

Figure 11:
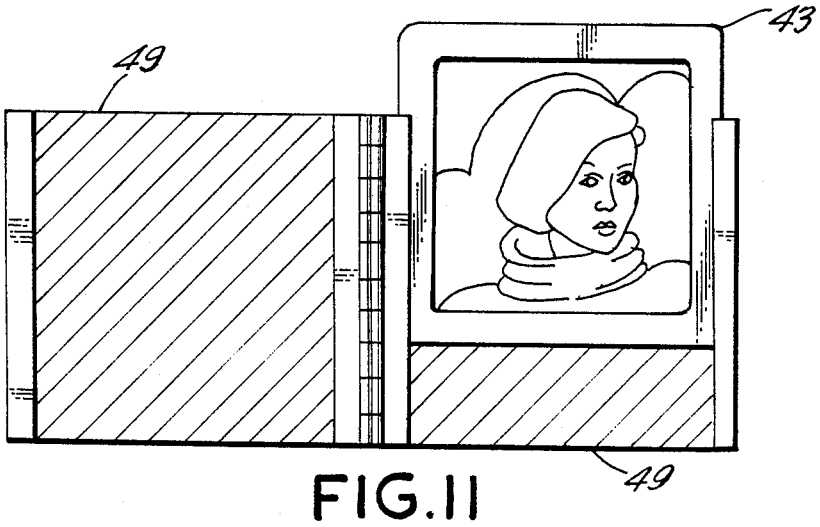
FIG. 11 is a further illustration of the interlocking of only two of the pages as illustrated in FIG. 6 wherein said pages are adjacent to each other so as to define a singular planar surface.

Additionally, reference is made to FIG. 11, wherein there is illustrated two separate and distinct pages consistent with the structure as illustrated in FIG. 8 and as referred to therein generally be reference numeral 49, wherein said pages are interconnected in accordance with the invention such that a 180 degree planar surface is illustrated by both of said respective pages, whereupon there is further illustrated the insertion of mat structure 43 upon one of the pages therein illustrated by having said structure slide between the spacing created between guide members 51 and 53, and center core member 38, as further illustrated in FIGS. 8 and 9 of the drawings.

In keeping with the invention and as illustrated in FIG. 11, it is also within the scope of this invention to have the structure, as illustrated in FIG. 11, utilized independently from that of an album concept. As yet a further alternative embodiment of the invention, said structure can be utilized for purposes of displaying material by way of and otherwise consistent with a picture frame design. As illustrated in FIG. 11, the combining of two independent pages 49, as therein illustrated, can, in effect, cause said structure to be utilized as a picture frame capable of being self-standing, merely by causing an angular positioning to occur between both of said respective pages 49.

Similarly, and as was previously discussed in conjunction with the page embodiment referred to in FIGS. 1 through 7 of the drawings, the page 49 as set forth in FIGS. 8 through 11, is also capable of having the ability to receive mat structure 43 either on one face thereof or on both faces thereof, depending upon the intended utilization thereof.

In further keeping with the invention, reference now is herein made to FIGS. 12 through 16 of the drawings, wherein there is illustrated another alternative embodiment of the invention.

Figure 12:
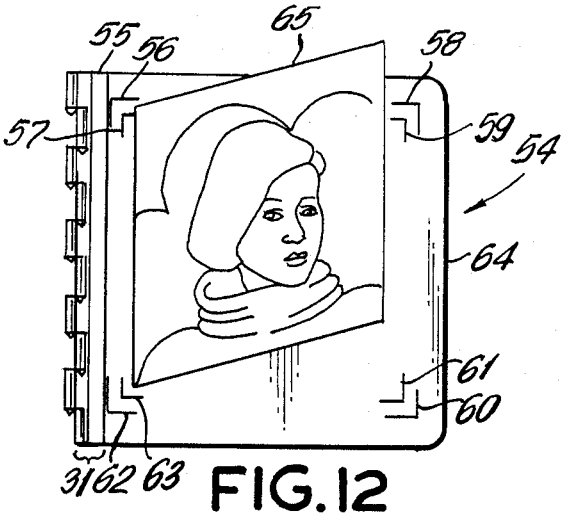
FIG. 12 is an alternative embodiment to the structure of the page as illustrated in FIG. 1 constructed in accordance with the invention wherein there is illustrated the insertion thereon of a picture.

More particularly , as illustrated in FIG. 12, page 54 is therein illustrated and comprises interconnecting spinal component 31 consistent with the structure illustrated in FIG. 3 of the drawings, said interconnecting spinal component 31 being structurally affixed to center core member 38 as a result of the utilization of strip member 55 being structurally affixed by way of adhesive material to interconnecting spinal component 31 and center core member 38 in a manner consistent with that discussed as related to FIG. 8.

Additionally, as illustrated in FIG. 12, page 54 has cut marks 56, 57, 58, 59, 60, 61, 62 and 63 formed in and otherwise through the surface of center core member 64 of page 54. As illustrated in FIG. 12, said cut marks 56 through 63 are right angular in nature and provide means to enable the mounting upon the surface of center core member 64 of picture 65, by the insertion therein of the corners of picture 65, same being in accordance with invention. The placement of cut marks 56 through 63 are such as to be compatible with the anticipated dimensions of the placing thereon of a particular picture 65 such that said cut marks define a geometric shape consistent with the shape of picture 65 that is to be utilized, however, said cut marks are placed and otherwise positioned to define an overall geometric shape that is compatible with that of picture 65 but having the distances between the respective corners as defined by said cut marks slightly less than that which equates to the equivalent measurements associated with picture 65. In this fashion, there is achieved the ability to insert the corners of picture 65 into the respective cut marks formed into and through the surface of center core member 64 such that upon the insertion into said respective cut marks picture 65 is structurally positioned upon the surface of center core member 64 consistent with the invention.

Figure 13:
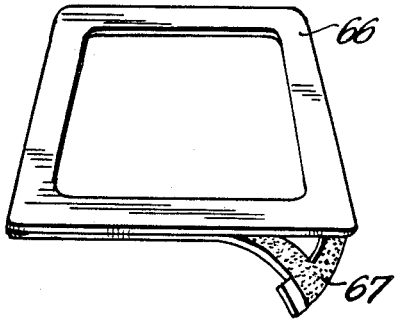
FIG. 13 is a perspective view of a mat constructed in accodance with the invention and capable of utilization with the mounting of the picture as illustrated in FIG. 12.
Figure 15:
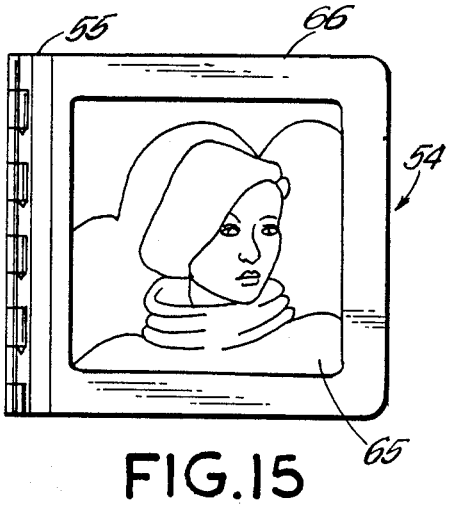
FIG. 15 is a front elevational view of the page of said album as illustrated in FIG. 14 with the mat as therein illustrated being mounted thereon in accordance with the invention.

As further illustrated in FIG. 13, mat 66 is depicted whereby there is defined a rectangular shape defining a center opening, the overall dimensions of mat 66 consistent with and otherwise compatible with the dimensions of center core member 64 such that upon the placement of mat 66 upon the surface of center core member 64 after picture 65 has been mounted thereon, and after having placed an edge of said mat 66 structurally adjacent to the edge of strip member 55, as illustrated in FIG. 15, there is achieved the ability of having mat 66 provide an aesthetically appealing framing appearance around picture 65 as well as having the outer dimensions of mat 66 be identical with and otherwise consistent with those of center core member 64.

Figure 14:
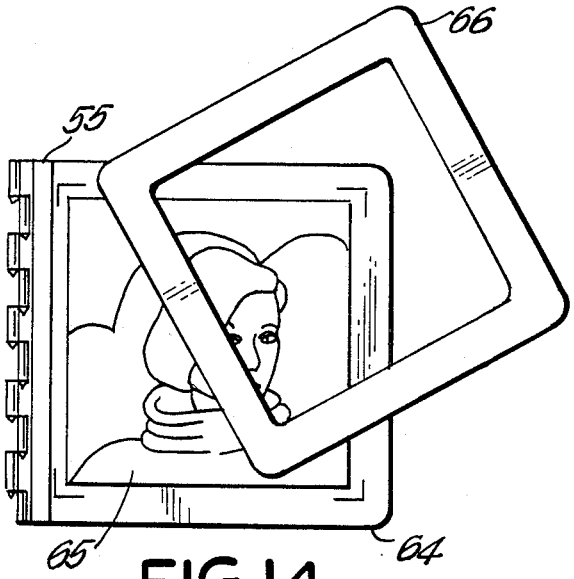
FIG. 14 is a perspective view of the mat of FIG. 13 being placed upon a page of an album as illustrated in FIG. 12 so as to permit the exposed adhesive surface appearing on the back of said mat to adhere to the page of said album.

As illustrated in FIG. 13, mat 66 has on its back surface adhesive material which is protected by peel off surface 67. As illustrated in FIGS. 13 through 15, after picture 65 is mounted upon the surface of center core member 64 consistent with the illustration in FIG. 12, peel off surface 67 is removed from mat 66 (FIG. 13) and there is then placed upon the surface of center core member 64, mat 66 such that the exposed adhesive surface of mat 66 comes into direct contact with the surfaces of center core member 64, one edge of mat 66 abutting up against and otherwise adjacent to strip member 55.

As illustrated in FIG. 15, there is a completed page consistent with this alternative embodiment of the invention whereby a picture has aesthetically been mounted upon page 54, the opening formed and otherwise defined by mat 66 being such as to provide an aesthetically appealing border around picture 65 and of such dimensions as to otherwise cover over cut marks 56 through 63.

Figure 16:
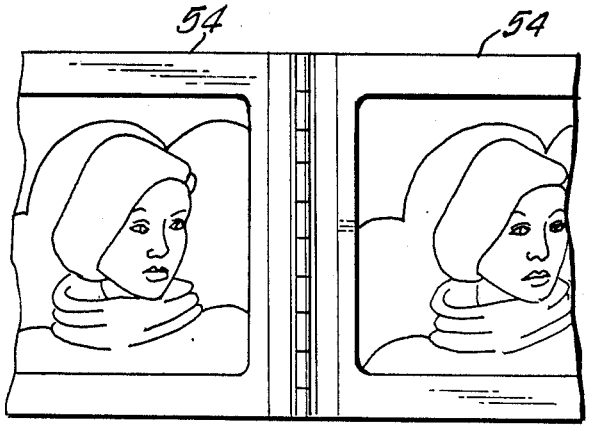
FIG. 16 is a partial front elevational view of two pages of an album constructed in accordance with the invention opened to evidence a uniform flat plane surface.
Figure 17:
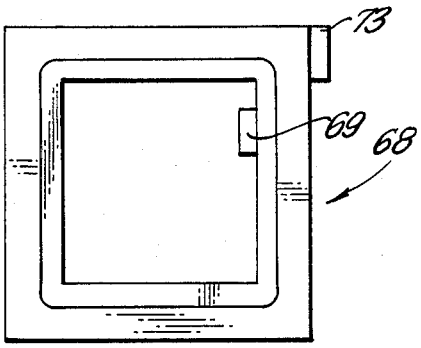
FIG. 17 is an alternative mat design capable of utilization with the page of FIG. 2 in accordance with the invention.

As illustrated in FIG. 16, there is depicted two assembled pages each constructed in accordance with this alternative embodiment of the invention and generally designated by reference numeral 54.

It should be noted that as illustrated in FIG. 16, said structural arrangment can be such as to either evidence the utilization of page 54 consistent with the fabrication of an album in accordance with the present invention, or, in the alternative, and consistent with the present invention, illustrative of the utilization of page 54 in a fashion consistent with the providing of a picture frame arrangement for picture 65.

Reference is now herein made to FIGS. 17 through 21 wherein there is further illustrated a further alternative embodiment of the present invention.

Figure 21:
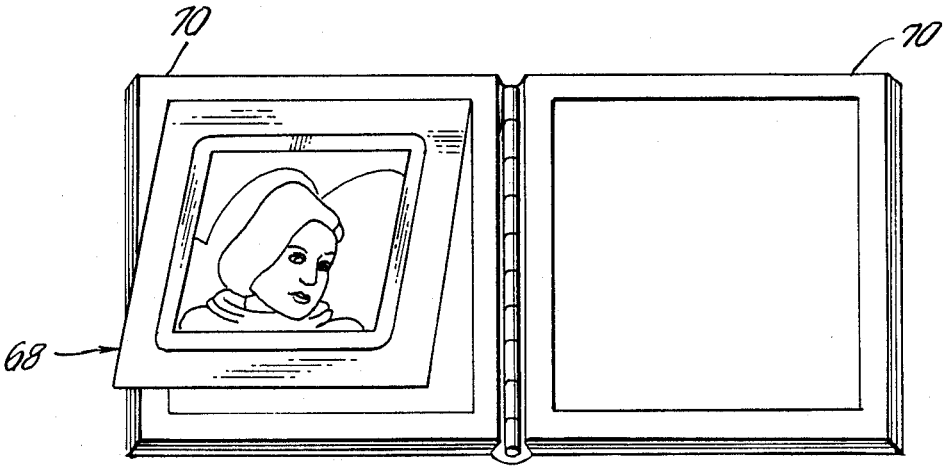
FIG. 21 is a perspective view of the pages of an album constructed in accordance with the invention evidencing utilization of the mat illustrated in FIGS. 17 through 20.

More particularly, and as illustrated in FIG. 21, there is illustrated a page structure 70 consistent with that depicted in FIG. 2 of the drawings, wherein interconnecting spinal component 31 is structurally affixed to center core member 38 by utilization of bottom guide member 39.

Upon utilizing the structure as referred to above and as illustrated in FIG. 2, the alternative embodiment of the invention as illustrated in FIGS. 17 through 21, draws upon the basic page structure as set forth in FIG. 2, however, thereafter, there is utilized, as illustrated in FIGS. 17 through 20, and in a fashion as illustrated in FIG. 21, the mounting of a picture upon said page by the utilization of mat structure 68.

Figure 18:
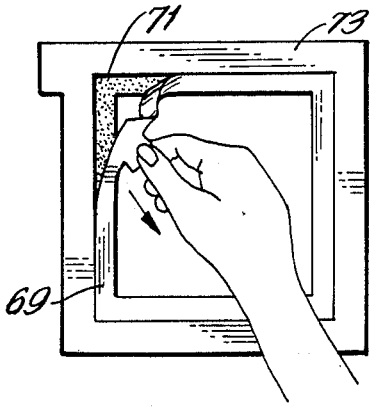
FIG. 18 evidences the first step in utilizing the alternate mat design of FIG. 17 in accordance with the mounting of a picture upon the page of said album as illustrated in FIG. 2.
Figure 19:
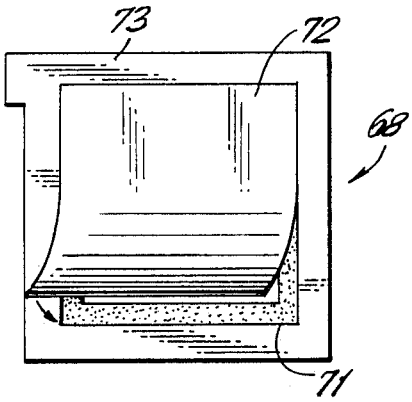
FIG. 19 evidences the second step in utilizing the alternate mat design of FIG. 17 in accordance with the mounting of a picture upon the page of said album as illustrated in FIG. 2.
Figure 20:
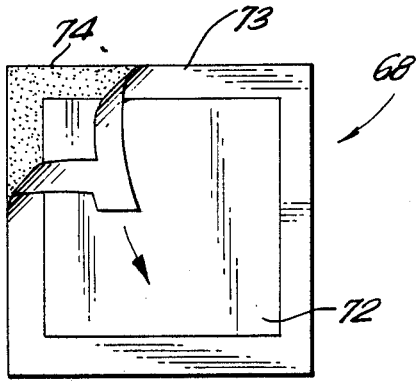
FIG. 20 evidences the third step in utilizing the alternate mat design of FIG. 17 in accordance with the mounting of a picture upon the page of said album as illustrated in FIG. 2.

More particularly, and making reference of FIG. 18, there is depicted the back surface of mat structure 68, which is basically rectangular in shape, and defining a center rectangular opening. Furthermore, the entire back surface of mat structure 68 as illustrated in FIGS. 18 through 20, has affixed thereto, adhesive material, capable of causing mat structure 68 to be structurally affixed to any surface upon which said adhesive material is exposed.

In further keeping with the invention, and as illustrated in FIGS. 17 through 20, the adhesive surface of the back portion of mat 68 is protected from exposure by two separate and distinct coverings, each being capable of being selectively removed so as to expose a particular designated surface area.

More particularly, as illustrated in FIG. 18, protective covering 69 is rectangular in shape defining a center opening consistent with the center opening formed in mat structure 68 and whose overall exterior dimensions are consistent with the exterior dimensions of a particular picture that is to be mounted thereon.

In keeping with the invention, and in accordance with the mounting of a particular picture upon page 70 of FIG. 21, mat structure 68 initially has removed from its back surface, protective covering 69 thereby exposing adhesive surface 71 such that picture 72 can be structurally mounted thereon.

Once picture 72 has been mounted upon mat structure 68 as illustrated in FIG. 19, there is then removed protective covering 73 from the back portion of mat structure 68 thereby exposing adhesive surface 74.

As illustrated in FIG. 21, mat structure 68, once adhesive surface 74 has been exposed by removal of protective covering 73, is then placed upon the surface of page 70 in accordance with the illustration set forth in FIG. 21 so as to structurally mount upon the surface of page 70 picture 65 as it has been mounted upon mat structure 68.

Figure 22:
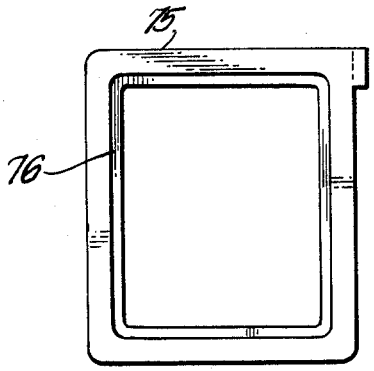
FIG. 22 is a front elevational view of an alternative mat structure constructed in accordance with the invention.
Figure 23:
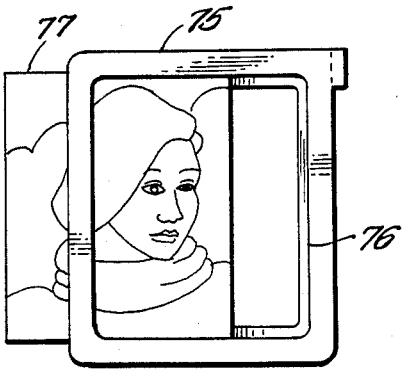
FIG. 23 is a front elevational view of the mat depicted in FIG. 23 with a partially inserted photograph.
Figure 24:
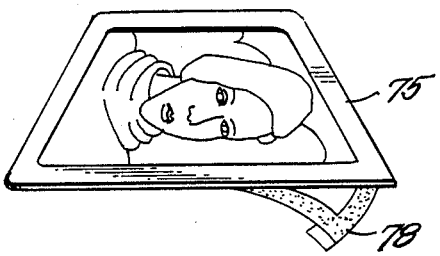
FIG. 24 is a perspective view of the mat of FIG. 23 having a picture inserted therein wherein there is further depicted the removal of the protective covering over an adhesive surface.

Reference is now herein made to FIG. 22, FIG. 23 and FIG. 24 wherein there is illustrated an alternative mat arrangement capable of utilization in accordance with the invention in conjunction with the structure of page 30 as depicted in FIG. 2.

Referring now to FIG. 22 there is therein set forth mat 75 evidencing a recessed opening 76 capable of receiving the insert of a photograph 77 as further depicted in FIG. 23. Mat 75 is constructed in accordance with techniques well-known within the prior art wherein as depicted in FIG. 23, as envelope arrangement is created capable of receiving the insert of a photograph 77 which, when once inserted within mat 75, there is created an aesthetically appealing arrangement as depicted in FIG. 24 whereby a photograph is given the appearance of being professionally mounted within an aesthetically appealing framed setting.

In keeping with the invention, and as depicted in FIG. 24, protective covering 78 is affixed to the back portion of mat 75 such that it covers an adhesive surface affixed to the back of mat 75 such that upon removal of protective covering 78 from the back of mat 75 there is exposed the adhesive surface which in effect borders the perimeter of the back of mat 75.

In keeping with the invention, reference is made to FIG. 2 of the drawings whereby page 30 is depicted and capable of receiving mat 75 with photograph 77 therein inserted after protective covering 78 has been removed from the back portion of mat 75, the insertion onto center core member 38 of mat 75 resulting in the mounting upon page 30 of a picture appearing in a professionally mounted format.

In furtherance of the invention, it should additionally be understood, that although the illustrated embodiment thereof deal with an album, nothing herein should be considered so limiting. On the contrary, the invention herein set forth is capable of being embodied in any manner comparable to a book, booklet, pamphlet, volume of material, or other compilation of individual page members selectively bound about a common binding, or, in the alternative, as a format for a picture frame or combination of picture frames. Furthermore, it should further be noted that nothing hereing contained should be considered to limit the scope of the present invention to a particular structure associated with the interconnecting spinal component portion of a particular page, which has heretofore been referred to by reference numeral 31 and as illustrated in the drawings. More particularly, any interconnecting spinal component means is within the scope of this invention as long as same is capable of utilization in the constructing of a binding relationship consistent with the disclosure as herein set forth.

The preceding description and accompanying drawings relate primarily to a specific embodiment of the invention, and the invention in its broader aspects should not be so limited to one specific embodiment as herein shown and described, but departures may be made therefrom within the scope of the accompanying claims without departing from the principles of the invention and without sacrificing its chief advantages.

I claim:

1. An album design comprising individualized page members that are capable of selectively being intercoupled therebetween so as to form an album of any number of desired pages having mounted thereon pictures or other display items wherein said individualized pages of said album comprise:

(i) a center core member having cut marks formed therein capable of allowing for the insertion therethrough of a corner of a picture;

(ii) an interconnecting spinal component structurally affixed to said center core member;

(iii) a strip member structurally affixed to said center core member immediately adjacent to said interconnecting spinal component;

(iv) a mat member defining a center opening having adhesive material appearing upon one surface thereof, said mat member being structurally affixed to said center core member so as to be immediately adjacent to said strip member so as to thereby provide an aesthetically appealing display around the perimeter of said picture which is mounted upon said center core member.

2. An album design comprising individualized page members that are capable of selectively being intercoupled therebetween so as to form an album of any number of desired pages having mounted thereon pictures or other display items wherein said individualized pages of said album comprise:

(i) a center core member;

(ii) an interconnecting spinal component structurally affixed to said center core member;

(iii) a bottom guide member defining a center opening structurally affixed to the face of said center core member as well as to said interconnecting spinal component so as to provide structural integrity therebetween;

(iv) a top guide member defining a center opening compatible with displaying therethough in an aesthetic manner a picture or other display item whereby said top guide member is structurally affixed to said bottom guide member along the common surface therebetween except for that portion of said top guide member that is parallel to and otherwise adjacent to said interconnecting spinal component as well as a defined set back portion of said top guide member that surrounds the center opening defined by said top guide member; and (v) a mat structure capable of having displayed thereon a picture or other display item, said mat structure being compatible with being inserted between said top guide member and said bottom guide member of said page where said top guide member and said bottom guide member are not structurally affixed so as to result in having displated upon said page after the insertion of said mat structure an aesthetically appealing format.

3. An album design comprising individualized page members that are capable of selectively being intercoupled therebetween so as to form an album of any number of desired pages having mounted thereon pictures or other display items as described in claim 1 wherein there appears on both sides of said center core member so as to achieve the mounting on both sides thereof a bottom guide member and a top guide member.

4. An album design comprising individualized page members that are capable of selectively being intercoupled therebetween so as to form an album of any number of designed pages having mounted thereon pictures or other display items wherein said individualized pages of said album comprise:

(i) a center core member;

(ii) an interconnecting spinal component structurally affixed to said center core member;

(iii) a first strip member structrually affixed to said center core member immediately adjacent to said interconnecting spinal component;

(iv) a second strip member structurally affixed to said center core member running parallel to said first strip member but immediately adjacent to the edge of said center core member directly opposite to the edge of said center core member that is adjacent to said interconnecting spinal component;

(v) a first guide member structurally affixed to said first strip member and having a width greater than said first strip member and running the entire length of said strip member so as to form between said first guide member and the planar surface of said center core member a first lateral opening;

(vi) a second guide member structurally affixed to said second strip member and having a width greater than said second strip member and running the entire length of said strip member so as to form between said second guide member and the planar surface of said center core member a second lateral opening; and (vii) a mat structure capable of having displayed thereon a picture or other display item, said mat structure being compatible with being inserted into said first lateral opening defined by said first guide member and said center core member as well as into said second lateral opening defined by said second guide member and center core member.

* * * * *